US009758281B2

(12) United States Patent
Glaser et al.

(10) Patent No.: US 9,758,281 B2
(45) Date of Patent: Sep. 12, 2017

(54) TAMPER-EVIDENT CLOSURE ASSEMBLY HAVING TWO TAMPER-EVIDENCING MEMBERS, AND RELATED METHODS

(71) Applicant: Fisher Scientific Company L.L.C., Fair Lawn, NJ (US)

(72) Inventors: John T. Glaser, Clifton Park, NY (US); Jack A. Rodriguez, Bernardsville, NJ (US)

(73) Assignee: Fisher Scientific Company, L.L.C., Fair Lawn, NJ (US)

( * ) Notice: Subject to any disclaimer, the term of this patent is extended or adjusted under 35 U.S.C. 154(b) by 680 days.

(21) Appl. No.: 14/199,659

(22) Filed: Mar. 6, 2014

(65) Prior Publication Data

US 2015/0251820 A1 Sep. 10, 2015

(51) Int. Cl.
*B65D 41/34* (2006.01)
*B65D 41/50* (2006.01)
(Continued)

(52) U.S. Cl.
CPC ..... *B65D 41/34* (2013.01); *B01L 3/50825* (2013.01); *B65D 41/3438* (2013.01);
(Continued)

(58) Field of Classification Search
CPC ..... B65D 41/34; B65D 41/3438; B65D 41/3447; B65D 51/002; B01L 3/50825; B01L 2200/141; B01L 2300/044
(Continued)

(56) References Cited

U.S. PATENT DOCUMENTS 1,981,414 A 11/1934 Hermani
2,077,027 A 4/1937 Torras
(Continued)

FOREIGN PATENT DOCUMENTS

EP 133348 A1 2/1985
EP 209356 A2 1/1987
(Continued)

OTHER PUBLICATIONS

International Searching Authority, International Search Report and Written Opinion, International Application No. PCT/US2015/034401, dated Jul. 13, 2015, 11 pp.
(Continued)

*Primary Examiner* — J. Gregory Pickett
*Assistant Examiner* — Niki M Eloshway
(74) *Attorney, Agent, or Firm* — Wood Herron & Evans LLP

(57) ABSTRACT

A tamper-evident closure assembly is provided for a container having a neck defining an opening. The closure assembly includes a base cap configured for securing with the neck of the container. The base cap includes an aperture for providing access to the opening of the container in the neck. The closure assembly further includes an overcap configured for securing with the base cap and configured to cover the aperture in the base cap when the overcap is secured to the base cap. First and second tamper-evidencing members are associated with the base cap and the overcap, respectively. The first tamper-evidencing member provides an indication when the base cap has been removed from the neck, and the second tamper-evidencing member provides an indication when the overcap has been removed from the base cap.

21 Claims, 4 Drawing Sheets

(51) Int. Cl.
*B01L 3/00* (2006.01)
*B65D 51/00* (2006.01)
*B65D 41/38* (2006.01)

(52) U.S. Cl.
CPC ..... *B65D 41/3447* (2013.01); *B65D 51/002* (2013.01); *B01L 2200/141* (2013.01); *B01L 2300/044* (2013.01)

(58) Field of Classification Search
USPC ..... 215/247, 252, 253, 310, 341, 249
See application file for complete search history.

(56) References Cited

U.S. PATENT DOCUMENTS 3,923,183 A 12/1975 Choksi et al.
3,923,184 A 12/1975 Choksi et al.
4,091,949 A 5/1978 Fowles et al.
4,441,620 A 4/1984 Tune
4,726,483 A 2/1988 Drozd
6,234,334 B1 * 5/2001 Suarez ..... B65D 41/3409 215/237
7,337,921 B2 3/2008 Ma
7,527,161 B2 5/2009 Rodriguez et al.
8,281,944 B2 10/2012 Battegazzore
8,292,103 B2 * 10/2012 Weist ..... B65D 47/0842 215/252
8,652,423 B2 * 2/2014 Shick ..... 215/247
2001/0020607 A1 * 9/2001 Chiarin ..... B01L 3/50825 215/247
2007/0102392 A1 * 5/2007 Hoepner ..... B65D 47/0885 215/237
2008/0023502 A1 * 1/2008 Knes ..... B65D 47/243 222/524
2008/0142473 A1 * 6/2008 Cho ..... B65D 51/285 215/252
2008/0169261 A1 * 7/2008 Druitt ..... B65D 47/0809 215/237
2010/0038279 A1 2/2010 Estep
2010/0127006 A1 * 5/2010 Krammes ..... A47G 19/2272 220/705
2012/0205338 A1 8/2012 Cheng
2013/0240530 A1 9/2013 Glaser et al.
2013/0245592 A1 9/2013 Glaser et al.
2015/0001108 A1 * 1/2015 Lee ..... B65D 47/2006 206/221
2015/0251819 A1 9/2015 Glaser et al.

FOREIGN PATENT DOCUMENTS

EP 515260 A1 11/1992
EP 1499535 A1 1/2005
GB 2172273 A 9/1986
GB 2430667 A 4/2007
WO 2009100274 A1 8/2009

OTHER PUBLICATIONS

U.S. Patent Office, Office Action in corresponding U.S. Appl. No. 14/298,365, dated Oct. 21, 2015 (10 pages).
U.S. Patent Office, Final Office Action in corresponding U.S. Appl. No. 14/298,365, dated Mar. 30, 2016 (9 pages).
European Patent Office, European Search Report in EP Application No. 15153759.6, dated Jul. 24, 2015 (8 pages).

* cited by examiner

TAMPER-EVIDENT CLOSURE ASSEMBLY HAVING TWO TAMPER-EVIDENCING MEMBERS, AND RELATED METHODS

TECHNICAL FIELD

The present invention relates generally to caps and closure assemblies for closing openings in containers and, more particularly, to caps and closure assemblies including a tamper evident feature.

BACKGROUND

Caps and closure assemblies are used to close containers, such as bottles. In a simplified example, a container holds contents (such as a liquid) and includes an opening. A cap can be provided for closing the opening. By closing the opening, the contents of the container can be confined within the container and can be prevented from escaping through the opening.

Various caps and closure assemblies have been developed for different types of applications and for different types of containers. For example, in applications where it is important to ensure the integrity of a container's contents, tamper-evident features have been used to indicate whether or not a cap (or closure assembly) has been removed from the container. For example, the cap or closure assembly may break a frangible connection upon a first opening to indicate visually at all times thereafter that the cap or closure assembly has been opened at least once.

There remains a need for improvements in this area of closure assemblies having tamper-evident features, however.

SUMMARY OF THE INVENTION

The present invention provides improvements to overcome the shortcomings and drawbacks of contains, caps, and closure assemblies heretofore known. While the invention will be described in connection with certain embodiments, it will be understood that the invention is not limited to these embodiments. On the contrary, the invention includes all alternatives, modifications and equivalents as may be included within the spirit and scope of the present invention.

In accordance with the principles of the present invention, a tamper-evident closure assembly is provided for a container having a neck defining an opening. The closure assembly includes a base cap configured for securing with the neck of the container, the base cap including an aperture configured for providing access to the opening of the container in the neck. The base cap further includes a membrane configured to be positioned between the aperture and the opening of the container when the base cap is secured with the neck of the container. The closure assembly further includes an overcap configured for securing with the base cap and configured to cover the aperture in the base cap when the overcap is secured to the base cap. The closure assembly further includes first and second tamper-evidencing members. The first tamper-evidencing member is associated with the base cap and is configured to provide an indication when the base cap has been removed from the neck. The second tamper-evidencing member is associated with the overcap and the base cap and is configured to provide an indication when the overcap has been removed from the base cap.

In some aspects, the first tamper-evidencing member includes a first band configured to be retained by the neck of the container when the base cap is removed from the neck. The first tamper-evidencing member may also include an upper ring frangibly connected with the first band. The upper ring is connected to the base cap, and the frangible connection between the upper ring and the first band is configured to be broken with the base cap is removed from the neck of the container. The base cap may include an annular socket that receives the upper ring. The base cap may further include a groove communicating with the annular socket, and the upper ring may include a rib that is received in the groove. The upper ring may further include a flange that engages a lower edge of the base cap. The band may include a retaining member, such as one or more fingers, for engaging a rib on the neck of the container to retain the first band on the neck when the base cap is removed from the neck.

In accordance with further principles of the present invention, a tamper-evident closure assembly is provided for a container having a neck defining an opening. The closure assembly includes a base cap configured for securing with a neck of the container, the base cap including an aperture configured for providing access to an opening of the container in the neck. The closure assembly further includes an overcap configured for securing with the base cap and configured to cover the aperture in the base cap when the overcap is secured to the base cap. The closure assembly further includes first and second tamper-evidencing members. The first tamper-evidencing member is associated with the base cap and is configured to be associated with the neck of the container. The first tamper-evidencing member includes an upper ring configured to be held by the base cap, and a first band frangibly connected to the upper ring and configured to be retained by the neck of the container. The frangible connection between the upper ring and the first band is configured to be broken when the base cap is removed from the neck of the container to provide an indication that the base cap has been removed from the neck. The second tamper-evidencing member is associated with the overcap and the base cap and is configured to provide an indication when the overcap has been removed from the base cap.

In accordance with even further principles of the present invention, a method is provided for closing a container having an opening in a neck. The method includes positioning a first tamper-evidencing member onto the neck. The first tamper-evidencing member includes an upper ring and a first band connected to the upper ring by a frangible connection. The method further includes positioning the first band over a rib on the neck, and positioning a base cap onto the neck. The base cap includes an aperture configured for providing access to the opening of the container, and a membrane configured to be positioned between the aperture and the opening of the container. The method further includes securing the base cap to the first tamper-evidencing member. The upper ring of the first tamper-evidencing member is retained by the base cap. The frangible connection between the upper ring and the first band is broken if the base cap is removed from the neck to provide an indication that the base cap has been removed from the neck. The method further includes securing the base cap to the neck, and securing an overcap to the base cap to cover the aperture of the base cap and to secure a second tamper-evidencing member onto the base cap. The second tamper-evidencing member includes a second band. The second band of the second tamper-evidencing member is retained by the base cap if the overcap is removed from the base cap to provide an indication that the overcap has been removed from the base cap.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
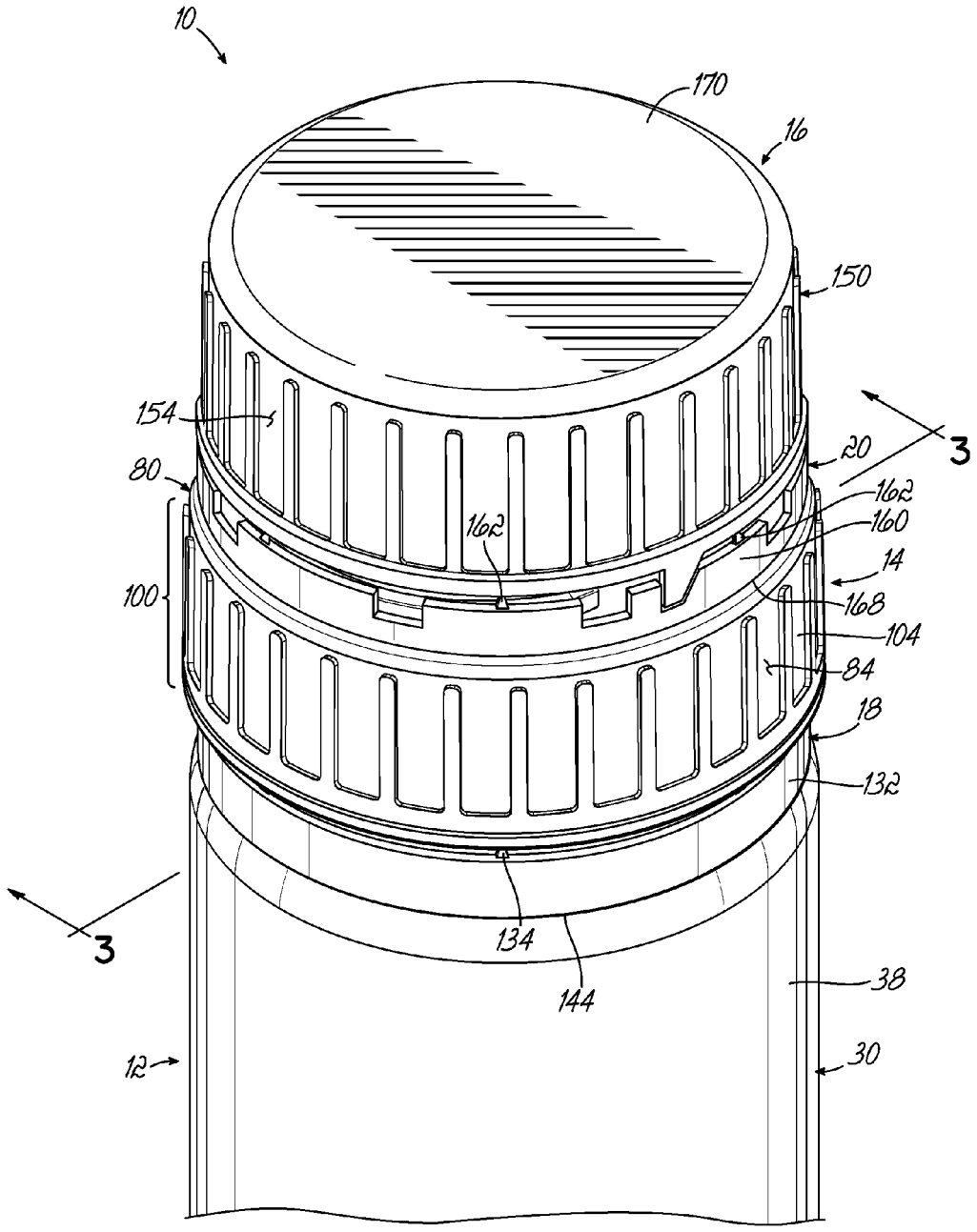
FIG. 1 is an isometric view showing a tamper-evident closure assembly in combination with a container according to an aspect of the invention.

Referring now to the figures, a tamper-evident closure assembly 10 is shown for securely closing or sealing a container 12. The closure assembly 10 generally includes a base cap 14 which is configured to be selectively and removably secured to the container 12, and an overcap 16 which is configured to be selectively and removably secured to the base cap 14. The closure assembly 10 also generally includes a first tamper-evidencing member 18 and a second tamper-evidencing member 20 that are configured to provide an indication when the base cap 14 and overcap 16 have been removed. In particular, the first tamper-evidencing member 18 is associated with the base cap 14 and is configured to provide an indication when the base cap 14 has been removed from the container 12. The second tamper-evidencing member 20 is associated with the overcap 16 and is configured to provide an indication when the overcap 16 has been removed from the base cap 14.

The container 12 generally includes a body 30 that defines an internal space 32 (FIG. 3) for holding contents, such as a liquid. The closure assembly 10 closes or seals the container 12 so as to confine the contents to the internal space 32 and prevent them from leaking out. The body 30 includes a neck 34 that defines an opening 36 (FIG. 2) in the container 12. The body 30 also includes a main body portion 38 that is larger than the neck 34, and a shoulder 40 that is positioned generally between the main body portion 38 and the neck 34.

The neck 34 includes a rim 42 at a location generally opposite the shoulder 40, and the rim 42 includes an upper rim surface 44. The neck 34 also includes a threaded portion 46 below the rim 42. The threaded portion 46 is on an exterior 48 of the neck 34 and is configured for threadably securing the base cap 14 to the neck 34, as will be explained below. The neck 34 also includes a first rib 50 and a second rib 52 on the exterior 48, both of which are below the threaded portion 46.

Figure 3:
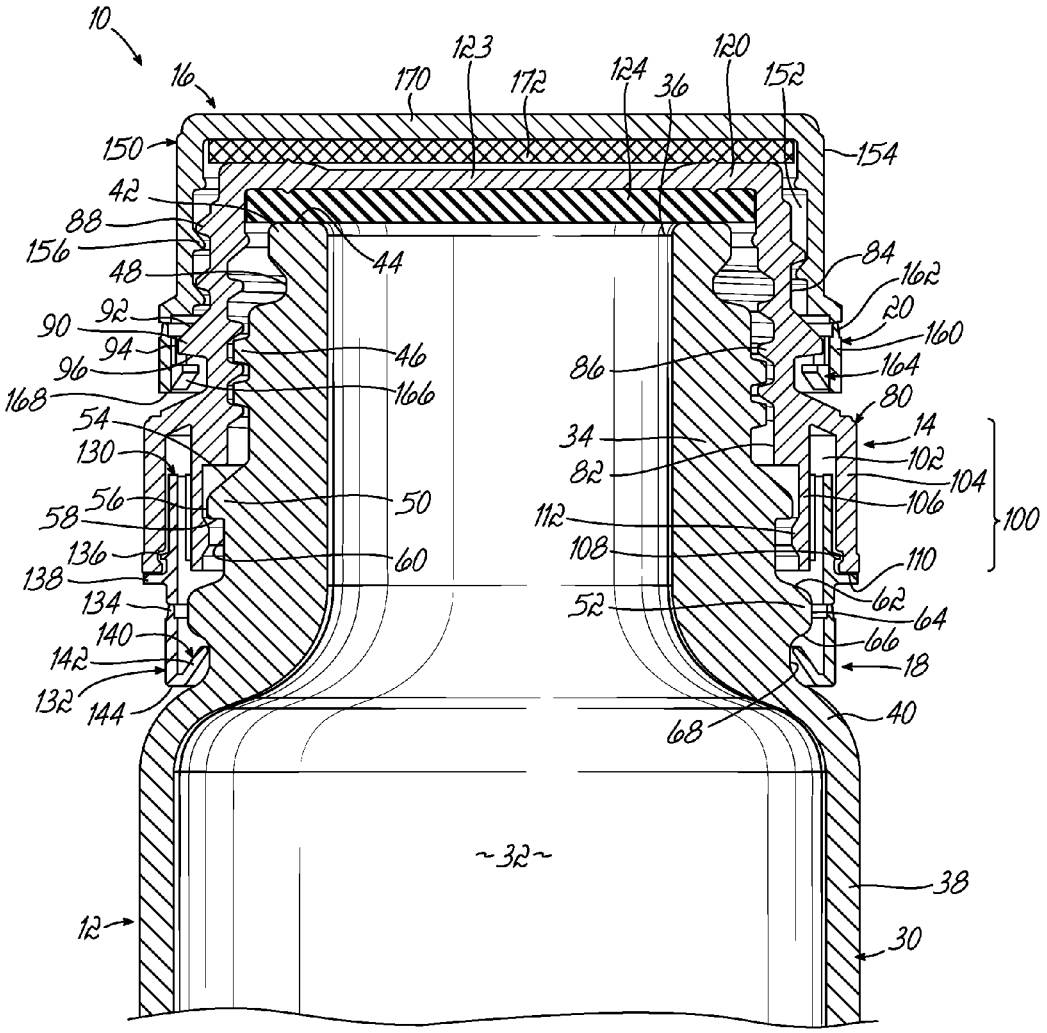
FIG. 3 is a cross-sectional view taken along line 3-3 of FIG. 1 and showing the relationship between the tamper-evident closure assembly and the container.

As shown in FIG. 3, the first rib 50 extends radially outward from and around the circumference of the neck 34, and includes an upper surface 54 that slopes downwardly and away from the rest of the neck 34. A side surface 56 of the first rib 50 extends downwardly from the end of the upper surface 54. The first rib 50 further includes an underside 58 opposite the upper surface 54 and extending between the side surface 56 and the rest of the neck 34. A first free space 60 is defined on the exterior 48 of the neck 34 between the first rib 50 and the second rib 52.

As also shown in FIG. 3, the second rib 52 extends radially outward from and around the circumference of the neck 34, and includes an upper surface 62 that extends away from the rest of the neck 34. A side surface 64 of the second rib 52 extends downwardly from the end of the upper surface 62. The second rib 52 further includes an underside 66 that extends between the side surface 64 and the rest of the neck 34. A second free space 68 is defined on the exterior 48 of the neck 34 between the second rib 52 and the shoulder 40.

Generally, the neck 34 of the container is configured to receive the closure assembly 10 so that the opening 36 of the container 12 is securely closed or sealed (FIGS. 1 and 3) to confine the contents held within the internal space 32. The coupling of the closure assembly 10 to the neck 34 is now described in further detail below.

Figure 4:
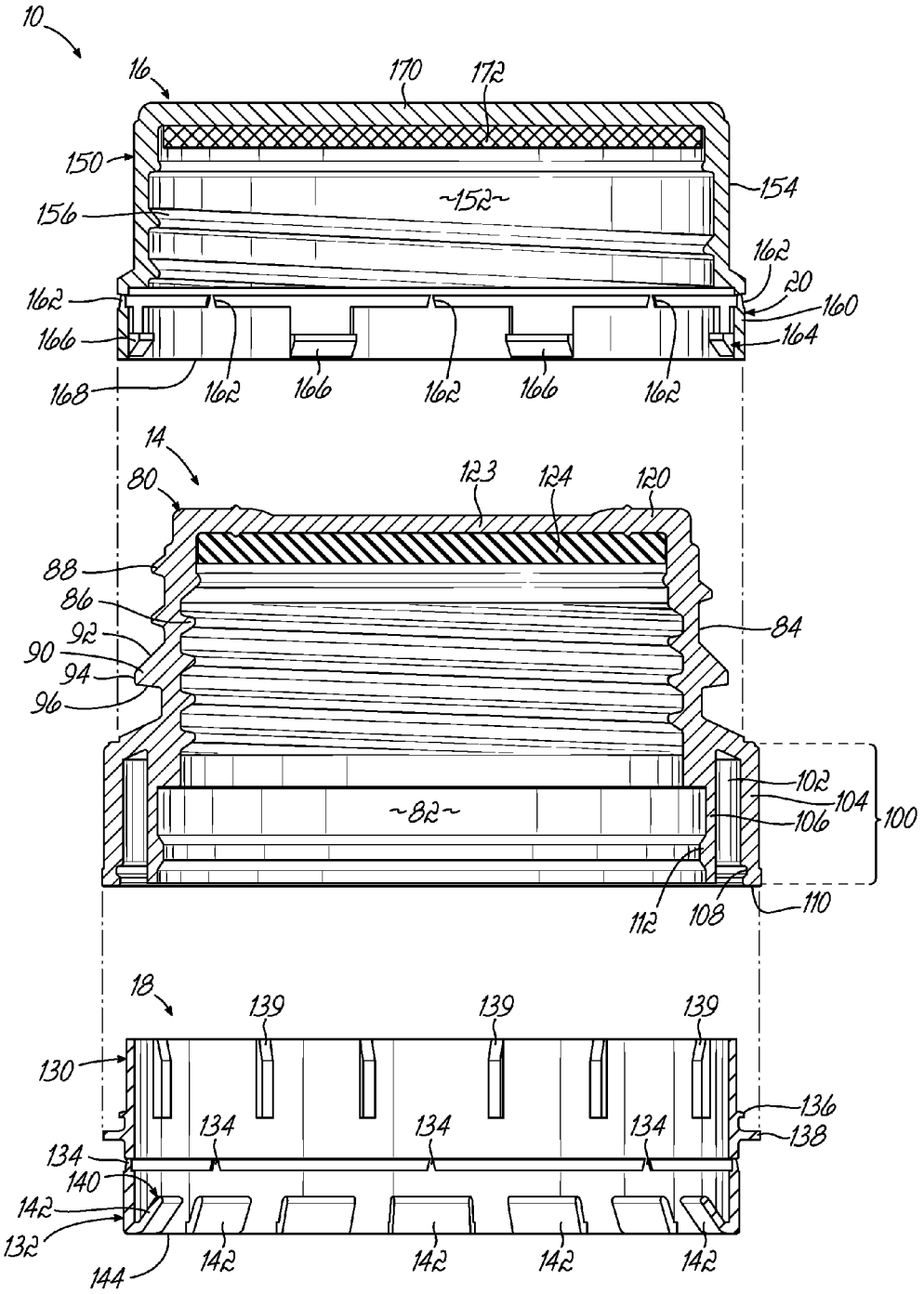
FIG. 4 is a cross-sectional view taken along line 4-4 of FIG. 2 and showing the partially exploded configuration of the tamper-evident closure assembly.

The base cap 14 is configured for securing with the neck 34 and generally includes a generally ring-shaped body 80 configured to fit around the exterior 48 of the neck 34. As shown in FIG. 4, the body 80 generally includes an interior 82 that faces the exterior 48 of the neck 34 when the base cap 14 is secured with the neck 34. The body 80 also includes an exterior 84 that faces away from the interior 82 and away from the neck 34 when the base cap 14 is secured with the neck 34.

The body 80 includes a threaded portion 86 on the interior 82 that is complementary to the threaded portion 46 on the neck 34. Thereby, the body 80 can be secured with the neck 34 by threading the threaded portions 46, 86 together, such as by rotating the body 80 around the neck 34 while preventing the neck 34 from rotating.

The body 80 also includes a threaded portion 88 on the exterior 84 for threadably securing the overcap 16 to the base cap 14, as will be explained below. A base cap rib 90 is provided on the exterior 84 of the body 80 below the threaded portion 88. The base cap rib 90 interacts with the second tamper-evidencing member 20, as will be explained below, and includes an upper surface 92 that slopes downwardly and away from the rest of the body 80. A side surface 94 of the base cap rib 90 extends downwardly from the end of the upper surface 92. The base cap rib 90 further includes an underside 96 that extends generally between the side surface 94 and the rest of the body 80.

With continued reference to FIG. 4, the body 80 also includes a lower skirt portion 100. In the embodiment shown, the lower skirt portion 100 is contoured (FIGS. 1 and 2) to allow a user to easily grip and manipulate the base cap 14. The lower skirt portion 100 includes an annular socket 102 that is defined between an outer circumferential wall 104 and an inner circumferential wall 106. Both the outer circumferential wall 104 and the inner circumferential wall 106 extend downwardly from the rest of the body 80. In the embodiment shown, the annular socket 102 is generally below the threaded portions 86, 88, and the base cap rib 90. The outer circumferential wall 104 includes a radially extending groove 108 that communicates with the annular socket 102. The lower skirt portion 100 defines a lower edge 110 of the body 80 and the base cap 14. The annular socket 102 extends upwardly from the lower edge 110. The lower skirt portion 100 also includes a radially inwardly extending protrusion 112 that is generally positioned in the first free space 60 of the neck 34 when the base cap 14 is secured to the neck 34 (FIG. 3). In particular, the protrusion 112 is provided on an inwardly facing surface of the inner circumferential wall 106.

The body 80 also includes a top end 120 that is configured to be positioned generally near the opening 36 of the neck 34 when the base cap 14 is secured to the neck 34. The top end 120 is positioned generally opposite the lower edge 110. The top end 120 includes at least one aperture 122 (FIG. 2) configured to provide access to the opening 36 of the container 12. In the embodiment shown, the top end 120 is constructed to provide four apertures 122 separated by generally perpendicular cross bar portions 123 (FIG. 2) formed in the top end 120. Also in the embodiment shown, the base cap 14 includes an optional membrane 124 that is configured to be positioned between the apertures 122 and the opening 36 of the container 12 when the base cap 14 is secured with the neck 34 (FIG. 3). In particular, when the base cap 14 is secured with the neck 34 in the configuration shown in FIG. 3, the membrane 124 rests on the upper rim surface 44, and is held between the top end 120 of the base cap 14 and the rim 42 of the neck 34. The cross bar portions 123 formed in the top end 120 support the membrane 124 to avoid having the membrane 124 pop out of the base cap 14 through the aperture(s) 122 when the base cap 14 is secured to the neck 34.

When the base cap 14 includes the membrane 124, the membrane 124 effectively closes the opening 36 of the container 12. The contents of the container 12 can still be accessed, however, such as by inserting a tubular needle (not shown) through the membrane 124 in order to draw the contents out of the container 12. It will be understood that the membrane 124 may be configured to resiliently close and reseal after withdrawal of the tubular needle.

Optionally, the top end 120 may be constructed without the cross bar portions 123. For example, the top end 120 may include a single aperture 122 of any appropriate size. The membrane 124 may, or may not, be included with a base cap 14 having such construction.

Figure 2:
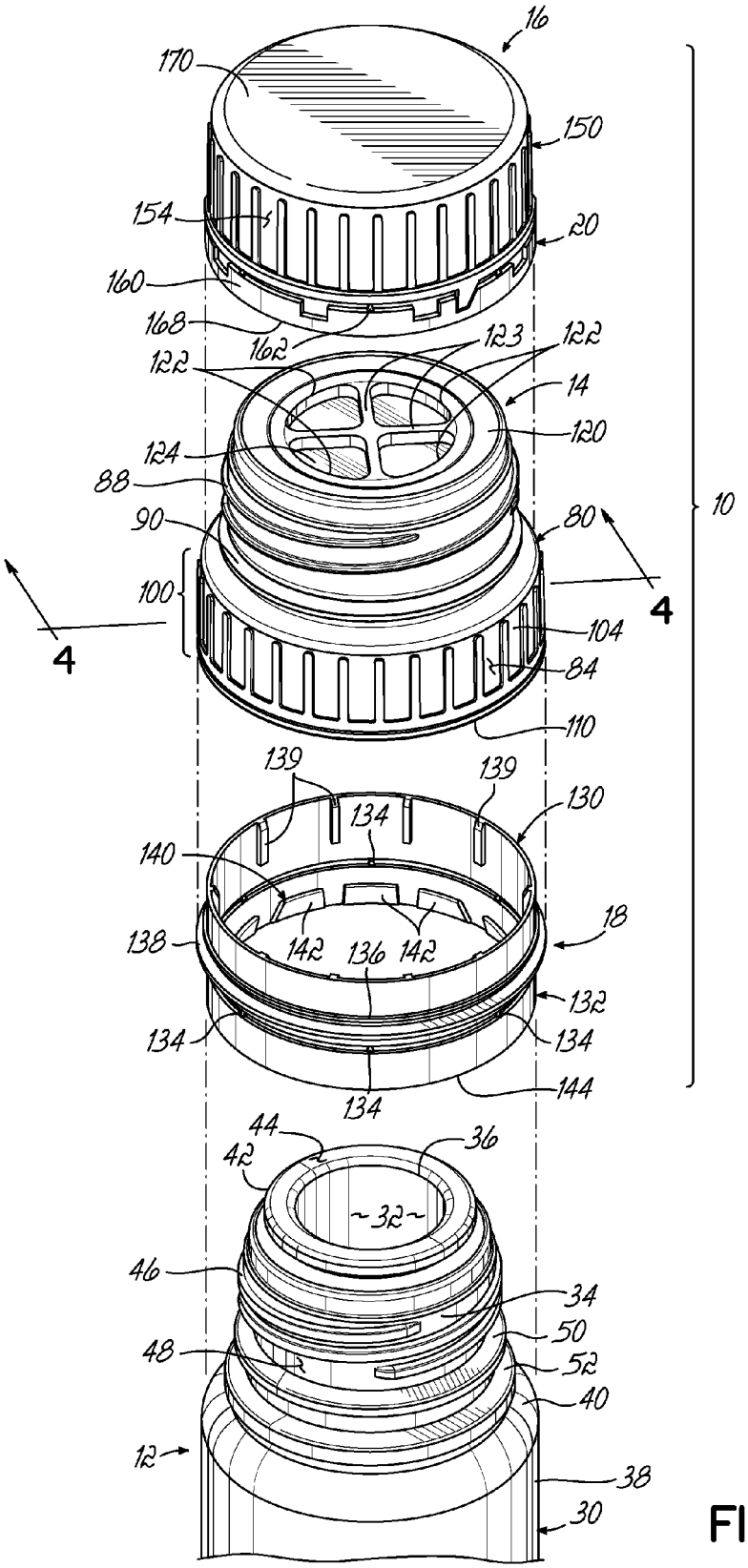
FIG. 2 is an isometric partially exploded view showing the tamper-evident closure assembly and the container of FIG. 1.

As discussed above, the first tamper-evidencing member 18 is associated with the base cap 14 and is configured to provide an indication when the base cap 14 has been removed from the container 12. Referring to FIGS. 2 and 4, the first tamper-evidencing member 18 generally includes an upper ring 130 and a band 132 frangibly connected with the upper ring 130. The band 132 is configured to be retained by the neck 34 when the base cap 14 is removed from the neck 34. In the embodiment shown, the frangible connection between the upper ring 130 and the band 132 is provided by a plurality of slender webs 134 that connect the upper ring 130 and the band 132. The frangible connection between the upper ring 130 and the band 132 is configured to be broken when the base cap 14 is removed from the neck 34 of the container 12. When the frangible connection is broken at the slender webs 134, it is visually evident that the base cap 14 has been removed at least once from the container 12.

The upper ring 130 is held by, or connects, with the base cap 14. In particular, the upper ring 130 is configured to be partially received in the annular socket 102, as shown in FIG. 3. The upper ring 130 includes a radially extending rib 136 that is received in the radially extending groove 108 of the base cap 14 when the upper ring 130 is received in the annular socket 102. The upper ring 130 also includes a radially extending flange 138, which is below the radially extending rib 136. The radially extending flange 138 engages the lower edge 110 of the base cap 14 when the upper ring 130 is received in the annular socket 102. The upper ring 130 also includes inwardly extending stand-off members 139 that fit within the annular socket 102 and may contact the inner circumferential wall 106 when the upper ring 130 is received in the annular socket 102. In this regard, the stand-off members 139 may be tapered at a leading end to help guide the upper ring 130 upon initial insertion into the annular socket 102. The stand-off members 139 also encourage the radially extending rib 136 into engagement with the radially extending groove 108 to ensure retention of the upper ring 130 within the annular socket 102. The radially extending rib 136, the radially extending flange 138, and the stand-off members 139 thereby assist in connecting the upper ring 130 with the base cap 14.

The band 132 includes a retaining member 140 configured to engage the second rib 52 on the neck 34 so as to retain the band 132 on the neck 34 when the base cap 14 is removed from the neck 34. In the embodiment shown, the retaining member 140 includes a plurality of radially inwardly extending fingers 142 that engage the underside 66 of the second rib 52 on the neck 34 (FIG. 3). The band 132 further includes a lower edge 144, and the fingers 142 extend upwardly and inwardly from the lower edge 144. The fingers 142 are therefore generally positioned in the second free space 68 of the neck 34 when the base cap 14 is secured to the neck 34.

The overcap 16 is configured for securing with the base cap 14. The overcap 16 covers the aperture(s) 122 in the base cap 14 when the overcap 16 is secured with the base cap 14 (FIGS. 2 and 3). As shown in FIG. 4, the overcap 16 includes a generally cup-shaped body 150 configured to fit onto the base cap 14. The body 150 includes an interior 152 that faces the exterior 84 of the base cap 14 when the overcap 16 is secured with the base cap 14. The body 150 also includes an exterior 154 that faces away from the interior 152 and away from the base cap 14 when the overcap 16 is secured with the base cap 14. In the embodiment shown, the exterior 154 is contoured (FIGS. 1 and 2) to allow a user to easily grip and manipulate the overcap 16.

The body 150 includes a threaded portion 156 on the interior 152 that is complementary to the threaded portion 88 on the exterior 84 of the base cap 14. Thereby, the body 150 of the overcap 16 can be secured with the base cap 14 by threading the threaded portions 156, 88 together, such as by rotating the body 150 around the base cap 14 while preventing the base cap 14 from rotating.

As described above, the second tamper-evidencing member 20 is associated with the overcap 16 and is configured to provide an indication when the overcap 16 has been removed from the base cap 14. As shown in FIG. 4, the second tamper-evidencing member 20 generally includes a band 160 frangibly connected with the overcap 16. The band 160 is configured to be retained by the base cap 14 when the overcap 16 is removed from the base cap 14. In the embodiment shown, the frangible connection between the band 160 and the overcap 16 is provided by a plurality of slender webs 162 that connect the band 160 and the overcap 16. The frangible connection between the band 160 and the overcap 16 is configured to be broken when the overcap 16 is removed from the base cap 14. When the frangible connection is broken at the slender webs 162, it is visually evident that the overcap 16 has been removed at least once from the base cap 14.

The band 160 includes a retaining member 164 configured to engage the base cap rib 90 so as to retain the band 160 on the base cap 14 when the overcap 16 is removed from the base cap 14. In the embodiment shown, the retaining member 164 includes a plurality of radially inwardly extending fingers 166 that engage the underside 96 of the base cap rib 90 on the base cap 14 (FIG. 3). The band 160 further includes a lower edge 168, and the fingers 166 extend upwardly and inwardly from proximate the lower edge 168.

The overcap 16 includes a closed top end 170 that covers the aperture(s) 122 of the base cap 14 when the overcap 16 is secured to the base cap 14. In the embodiment shown, the overcap 16 further includes a seal member 172 (FIG. 4) configured to be positioned between the closed top end 170 and the base cap 14 when the overcap 16 is secured to the base cap 14. The seal member 172 assists in forming a sealed closure of the container 12 for confining the contents contained therein to the internal space 32. It will be understood that the seal member 172 may be adhered to or otherwise retained by coupling to the top end 170.

If the base cap 14 does not include the membrane 124, the seal member 172 may contribute substantially to confining the contents of the container 12 to the internal space 32. Particularly, when the overcap 16 is secured to the base cap 14, the seal member 172 (of the overcap 16) would form a sealing relationship with the top end 120 (of the base cap 14) in such a manner that prevents the contents of the container 12 from exiting through the aperture(s) 122 of the top end 120.

Once the closure assembly 10 is installed on the container 12, the opening 36 of the container 12 can be accessed in two ways. First, the entire closure assembly 10 can be removed from the container 12 by removing the base cap 14 from the neck 34. This would provide direct access to the opening 36, allowing a user to either add contents to the internal space 32 of the container 12, or remove contents therefrom. Second, the overcap 16 can be removed from the base cap 14. This would provide indirect access to the opening 36 via the aperture(s) 122 in the base cap 14 (and via the membrane 124 in the base cap, if present), also allowing a user to either add contents to the internal space 32 of the container 12, or remove contents therefrom.

The components of the closure assembly 10 may be formed of or contain any appropriate material. For example, the base cap 14, the overcap 16, the first tamper-evidencing member 18, and the second tamper-evidencing member 20 may be formed of similar or different materials. The membrane 124, if present, may also be formed of or contain any appropriate material. For example, the membrane 124 may be formed to prevent transmission of ambient moisture into the internal space 32 of the container 30 and to prevent reaction with the contents confined within the internal space 32. In some embodiments, the membrane 124 may have the structure of the septum described in U.S. Publication No. 2013/0240530, the disclosure of which is hereby incorporated by reference in its entirety. In addition, the seal member 172 of the overcap 14 may be formed of or contain any appropriate material.

The closure assembly 10 can be used in combination with the container 12 in accordance with a method for closing the container 12 as follows. The first tamper-evidencing member 18 is positioned onto the neck 34 of the container 12. The band 132 of the first tamper-evidencing member 18 is positioned over the second rib 52 on the neck 34. The retaining member 140 of the first tamper-evidencing member 18 is snapped over and into engagement with the second rib 52 on the neck 34. In particular, the fingers 142 of the retaining member 140 engage the underside 66 of the second rib 52.

The base cap 14 is positioned on the neck 34 and secured to the first tamper-evidencing member 18. In particular, the upper ring 130 of the first tamper-evidencing member 18 is retained by the base cap 14 such that the frangible connection between the upper ring 130 and the band 132 is broken if the base cap 14 is removed from the neck 34. This provides an indication that the base cap 14 has been removed from the neck 34. The upper ring 130 may be partially positioned in the annular socket 102 of the base cap 14. Also, the radially extending rib 136 of the upper ring 130 may be positioned in the radially extending groove 108 of the base cap 14, thereby preventing removal of the upper ring 130 from the base cap 14. The base cap 14 is secured to the neck 34 by threadably connecting the threaded portion 86 of the base cap 14 with the threaded portion 46 of the neck 34.

The overcap 16 is secured to the base cap 14 by threadably connecting the threaded portion 156 of the overcap 16 with the threaded portion 88 of the base cap 14. Thereby, the overcap 16 covers the aperture(s) 122 of the base cap 14. In addition, the second tamper-evidencing member 20 is secured onto the base cap 14. In particular, the band 160 of the second tamper-evidencing member 20 snaps over and into engagement with the base cap rib to be retained by the base cap 14 if the overcap 16 is removed from the base cap 14. This provides an indication that the overcap 16 has been removed from the base cap 14.

The overcap 16 may be secured to the base cap 14 either before or after the base cap 14 is secured to the neck 34. Also, the first tamper-evidencing member 18 may be secured to the base cap 14 either before or after the first tamper-evidencing member is positioned onto the neck 34.

The closure assembly 10 thereby provides several advantages. By including two tamper-evidencing members 18, 20, the closure assembly 10 provides visual indications if the opening 36 of the container 12 has been accessed at least once. Access to the opening 36 is provided either (1) by removing the base cap 14 from the neck 34, or (2) by removing the overcap 16 from the base cap 14. In particular, when the base cap 14 is removed from the neck 34, the frangible connection between the upper ring 130 and the band 132 is broken, thereby providing a visual indication that the base cap 14 has been removed at least once from the container 12. Also, when the overcap 16 is removed from the base cap 14, the frangible connection between the overcap 16 and the band 160 is broken, thereby providing a visual indication that the overcap 16 has been removed at least once from the base cap 14. Advantageously, the closure assembly 10 may be used in conjunction with many existing container designs to provide tamper-evident features for those containers. Moreover, the closure assembly 10 is of relatively simple construction, and is easy to install onto a container.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. For example, the particular tamper-evident closure assembly 10 and container 12 shown in the figures are merely exemplary, and it will be appreciated that the teachings contained herein also apply to other closure assembly and container configurations, as well.

The invention in its broader aspects is therefore not limited to the specific details, representative apparatus and method and illustrative examples shown and described.

Accordingly, departures may be made from such details without departing from the scope or spirit of Applicant's general inventive concept.

Having described the invention, we claim:

1. A tamper-evident closure assembly for a container having a neck defining an opening, the tamper-evident closure assembly comprising:

a base cap configured for securing with the neck of the container and including an aperture configured for providing access to the opening of the container in the neck, the base cap further including a membrane configured to be positioned between the aperture and the opening of the container when the base cap is secured with the neck of the container, the membrane resiliently resealing closed to prevent communication through the opening of the container after contents of the container have been accessed through the membrane, an overcap configured for securing with the base cap and configured to cover the aperture in the base cap when the overcap is secured to the base cap, a first tamper-evidencing member associated with the base cap and configured to provide an indication when the base cap has been removed from the neck, the first tamper-evidencing member including a first band configured to be retained by the neck of the container when the base cap is removed from the neck, the first tamper-evidencing member further including an upper ring frangibly connected with the first band and connected to the base cap, wherein the frangible connection between the upper ring and the first band is configured to be broken when the base cap is removed from the neck of the container, and a second tamper-evidencing member associated with the overcap and the base cap and configured to provide an indication when the overcap has been removed from the base cap, the base cap further including a body with an outer circumferential wall and an inner circumferential wall extending downwardly from the body to define an annular socket therebetween, and the upper ring being configured to be partially received in the annular socket.

2. The tamper-evident closure assembly of claim 1, the first tamper-evidencing member further including a plurality of webs connecting the upper ring with the first band to form the frangible connection.

3. The tamper-evident closure assembly of claim 1, the base cap further including a radially extending groove communicating with the annular socket and the upper ring further including a radially extending rib configured to be received in the radially extending groove when the upper ring is received in the annular socket.

4. The tamper-evident closure assembly of claim 1, the base cap further including a lower edge and the upper ring further including a radially extending flange configured to engage the lower edge when the upper ring is received in the annular socket.

5. The tamper-evident closure assembly of claim 1, the first band including a retaining member configured to engage a rib on the neck of the container to retain the first band on the neck when the base cap is removed from the neck.

6. The tamper-evident closure assembly of claim 5, the retaining member including at least one radially inwardly extending finger configured to engage an underside of the rib on the neck of the container.

7. The tamper-evident closure assembly of claim 6, the at least one finger extending upwardly from proximate a lower edge of the first band.

8. The tamper-evident closure assembly of claim 1 in combination with a container having a neck defining an opening, the base cap being secured with the neck.

9. A tamper-evident closure assembly for a container having a neck defining an opening, the tamper-evident closure assembly comprising:

a base cap configured for securing with a neck of the container and including an aperture configured for providing access to an opening of the container in the neck, an overcap configured for securing with the base cap and configured to cover the aperture in the base cap when the overcap is secured to the base cap, a first tamper-evidencing member associated with the base cap and configured to be associated with the neck of the container, the first tamper-evidencing member including an upper ring configured to be held by the base cap, and a first band frangibly connected to the upper ring and configured to be retained by the neck of the container, wherein the frangible connection between the upper ring and the first band is configured to be broken when the base cap is removed from the neck of the container to provide an indication that the base cap has been removed from the neck, and a second tamper-evidencing member associated with the overcap and the base cap and configured to provide an indication when the overcap has been removed from the base cap, wherein the base cap further includes a body with an outer circumferential wall and an inner circumferential wall extending downwardly from the body to define an annular socket therebetween, and the upper ring is partially received in the annular socket when the first tamper-evidencing member is connected with the base cap.

10. The tamper-evident closure assembly of claim 9, the first tamper-evidencing member further including a plurality of webs connecting the upper ring with the first band to form the frangible connection.

11. The tamper-evident closure assembly of claim 9, the base cap further including a radially extending groove communicating with the annular socket and the upper ring further including a radially extending rib configured to be received in the radially extending groove when the upper ring is received in the annular socket.

12. The tamper-evident closure assembly of claim 9, the base cap further including a lower edge and the upper ring further including a radially extending flange configured to engage the lower edge when the upper ring is received in the annular socket.

13. The tamper-evident closure assembly of claim 9, the first band including a retaining member configured to engage a rib on the neck of the container to retain the first band on the neck when the base cap is removed from the neck.

14. The tamper-evident closure assembly of claim 13, the retaining member including at least one radially inwardly extending finger configured to engage an underside of the rib on the neck of the container.

15. The tamper-evident closure assembly of claim 14, the at least one finger extending upwardly from proximate a lower edge of the first band.

16. The tamper-evident closure assembly of claim 9 in combination with a container having a neck defining an opening, the base cap being secured with the neck.

17. A method of closing a container having an opening in a neck, comprising:

positioning a first tamper-evidencing member onto the neck, the first tamper-evidencing member including an upper ring and a first band connected to the upper ring by a frangible connection, positioning the first band over a rib on the neck, positioning a base cap onto the neck, the base cap including an aperture configured for providing access to the opening of the container, and the base cap further includes a body with an outer circumferential wall and an inner circumferential wall extending downwardly from the body to define an annular socket therebetween, securing the base cap to the first tamper-evidencing member, whereby the upper ring of the first tamper-evidencing member is retained by the base cap and the frangible connection between the upper ring and the first band is broken if the base cap is removed from the neck to provide an indication that the base cap has been removed from the neck, wherein securing the base cap to the first tamper-evidencing member further includes partially positioning the upper ring in the annular socket of the base cap, securing the base cap to the neck, and securing an overcap to the base cap to cover the aperture of the base cap and to secure a second tamper-evidencing member onto the base cap, the second tamper-evidencing member including a second band, whereby the second band of the second tamper-evidencing member is retained by the base cap if the overcap is removed from the base cap to provide an indication that the overcap has been removed from the base cap.

18. The method of claim 17, wherein the base cap further includes a membrane configured to be positioned between the aperture and the opening of the container, and the method further comprises:

resiliently resealing closed the membrane to prevent communication through the opening in the neck with the membrane after contents of the container have been accessed through the membrane.

19. The method of claim 17, wherein securing the base cap to the first tamper-evidencing member further includes positioning a radially extending rib of the upper ring in a radially extending groove of the base cap.

20. The method of claim 17, further comprising engaging the rib on the neck with a retaining member of the first tamper-evidencing member.

21. The method of claim 17, wherein the retaining member includes at least one radially inwardly extending finger, and wherein engaging the rib includes engaging an underside of the rib with the at least one radially inwardly extending finger.

* * * * *